US009379485B2

(12) United States Patent
Hashimoto

(10) Patent No.: US 9,379,485 B2
(45) Date of Patent: Jun. 28, 2016

(54) LEVER-TYPE CONNECTOR

(71) Applicant: Sumitomo Wiring Systems, Ltd., Yokkaichi, Mie (JP)

(72) Inventor: Norihito Hashimoto, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 14/254,936

(22) Filed: Apr. 17, 2014

(65) Prior Publication Data

US 2014/0315409 A1 Oct. 23, 2014

(30) Foreign Application Priority Data

Apr. 18, 2013 (JP) ..... 2013-087070

(51) Int. Cl.
*H01R 13/62* (2006.01)
*H01R 13/629* (2006.01)
*H01R 13/52* (2006.01)

(52) U.S. Cl.
CPC ..... *H01R 13/62938* (2013.01); *H01R 13/5219* (2013.01)

(58) Field of Classification Search
CPC ..... H01R 13/5219; H01R 13/62933; H01R 13/62938; H01R 13/62955; H01R 13/631
USPC ..... 439/271, 157, 910, 595
See application file for complete search history.

(56) References Cited

U.S. PATENT DOCUMENTS 6,544,054 B2 * 4/2003 Ishikawa ..... H01R 13/62933 439/157
7,303,437 B2 * 12/2007 Nishide ..... 439/595
8,979,560 B2 * 3/2015 Kobayashi ..... H01R 13/62933 439/157
2014/0120759 A1 * 5/2014 Suzuki ..... 439/345

FOREIGN PATENT DOCUMENTS

JP 2012-18877 1/2012

* cited by examiner

*Primary Examiner* — Amy Cohen Johnson
*Assistant Examiner* — Milagros Jeancharles
(74) *Attorney, Agent, or Firm* — Gerald E. Hespos; Michael J. Porco; Matthew T. Hespos

(57) ABSTRACT

A lever-type connector has a housing (20) and a linking wall (25) projects from the housing (20) to define a stop for a mating housing (90). A seal ring (70) is mounted adjacent to the linking wall (25) to provide sealing between the housing (20) and the mating housing (90). A lever (60) includes a coupling (61) and arm plates (62) to define a U-shape. The lever (60) is mounted from an outer side to straddle the housing (20). The linking wall (25) is arranged at a position facing the arm plates (62) from inner sides of the arm plates (62). Cam grooves (64) are provided in the arm plates (62) and function as confirmation windows through which the seal ring (70) is visible to confirm whether sealing is ensured.

6 Claims, 10 Drawing Sheets

LEVER-TYPE CONNECTOR

BACKGROUND

1. Field of the Invention

The invention relates to a lever-type connector.

2. Description of the Related Art

Japanese Unexamined Patent Publication No. 2012-18877 discloses a lever-type connector with a housing that is connectable to a mating housing. A seal ring is mounted on the housing and a lever is mounted rotatably on the housing. Two shafts project on opposite side surfaces of the housing. The lever has a coupling and two arm plates project from opposite ends of the coupling to define a U-shape. Each arm plate has a rotary shaft hole for receiving the shaft and a cam groove to be engaged with a cam pin of the mating housing.

The lever is mounted from an outer side to straddle the housing and is rotatable about the shafts with the shafts fit in the rotary shaft holes. In the process of connecting the housings, the lever is rotated while the cam pins are engaged with the cam grooves of the arm plates and a connecting operation of the housings proceeds by a force multiplying action exhibited with the rotation of the lever. Further, the mating housing is fit externally on the seal ring during the connecting operation of the two housings, and the seal ring is sandwiched in a fluid-tight manner between the two housings to provide sealing.

The mating housing is arranged at an outer side of the seal ring and the lever is arranged at a further outer side. Thus, the seal ring mounted on the housing cannot be seen from outside, and it is not possible to confirm whether the seal ring achieves sealing between the two housings when the housings are connected properly.

The invention was completed based on the above situation and aims to provide a lever-type connector that enables confirmation as to whether sealing is ensured.

SUMMARY OF THE INVENTION

The invention is directed to a connector with a housing that is connectable to a mating housing. Shafts and a contact-stop wall project on the opposite side surfaces of the housing. The contact-stop wall is capable of stopping the mating housing. A seal ring is mounted on the housing adjacent the contact-stop wall and is sandwiched in a fluid-tight manner between the two housings by being located inside the mating housing when the two housings are connected. A lever includes a coupling and arm plates project from opposite ends of the coupling to define a U-shape. The lever is mounted from an outer side to straddle the housing and exhibits a force multiplying action when rotated about the shafts while engaged with the mating housing for connecting the two housings. The contact-stop wall is at a position facing the arm plates from inner sides of the arm plates and a confirmation window is provided in the arm plate through which the seal ring is visible.

The seal ring is visible through the confirmation window in the arm plate. Thus, whether the housings are sealed appropriately by the seal ring can be confirmed by seeing a state of the seal ring through the confirmation window when the housings are connected.

The seal ring and the housing may be of different colors to improve visibility.

The confirmation window preferably is a cam groove that exhibits the force multiplying function by being engaged with a follower pin of the mating housing. Thus, it is not necessary to provide a dedicated structure as the confirmation window and the configuration of the lever can be simplified.

The housing includes outer deformation preventing walls located at outer sides of the arm plates to prevent excessive outward deformation of the arm plates when rotating the lever. The outer deformation preventing wall preferably includes an escaping portion that communicates with the confirmation window to make the seal ring visible. According to this arrangement, the outer deformation preventing walls preventing excessive outward deformation of the lever, while the escaping portions in the outer deformation preventing walls permit visual confirmation of sealing.

The shafts are exposed on a front end of the housing, which is connectable to the mating housing. A wall for covering an outer side of the seal ring is omitted from the housing in this configuration, and a mold can be pulled out from a connecting surface side when the shafts are formed. As a result, the shafts exposed on the connecting surface can be formed easily. Further, a degree of freedom in forming the shafts is increased and the shafts can be structured to be less likely to fracture.

DETAILED DESCRIPTION OF THE PREFERRED EMBODIMENTS

One embodiment of the invention is described with reference to FIGS. 1 to 10. A lever-type connector 10 of this embodiment includes a housing 20 connectable to a mating housing 90 and a lever 60 to be rotatably mounted on the housing 20.

Figure 4:
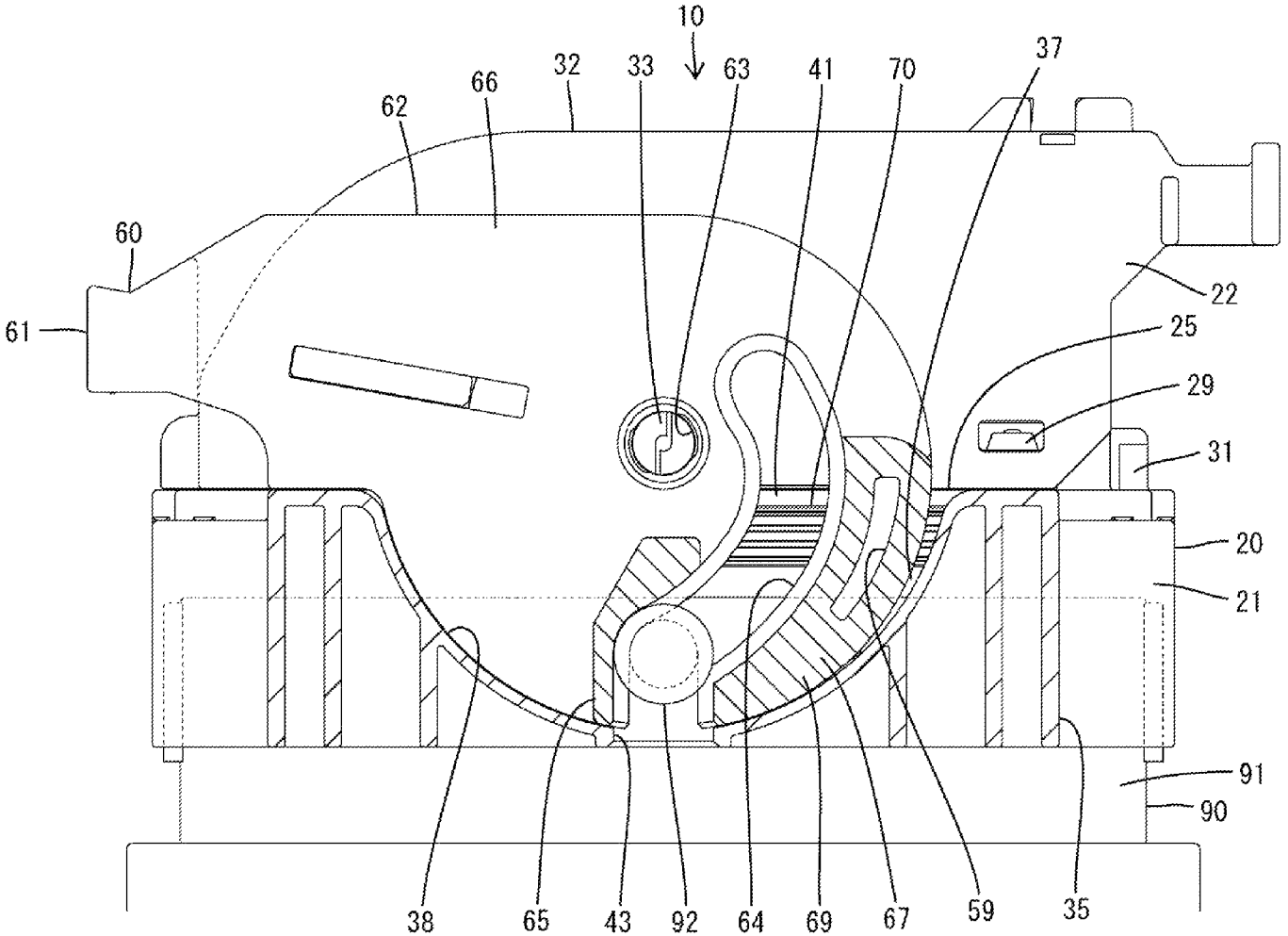
FIG. 4 is a plan view, partly in section, showing the lever at the initial position.

The mating housing 90 is made of synthetic resin and has a wide substantially rectangular tubular receptacle 91 as schematically shown in FIG. 4. Two follower pins 92 project on the outer surfaces of opposite longer side walls of the receptacle 91. Each follower pin 92 is substantially cylindrical and is in a substantially widthwise center of a front end part of the outer surface of each of the opposite side walls. Unillustrated male tabs project in the receptacle 91.

Figure 3:
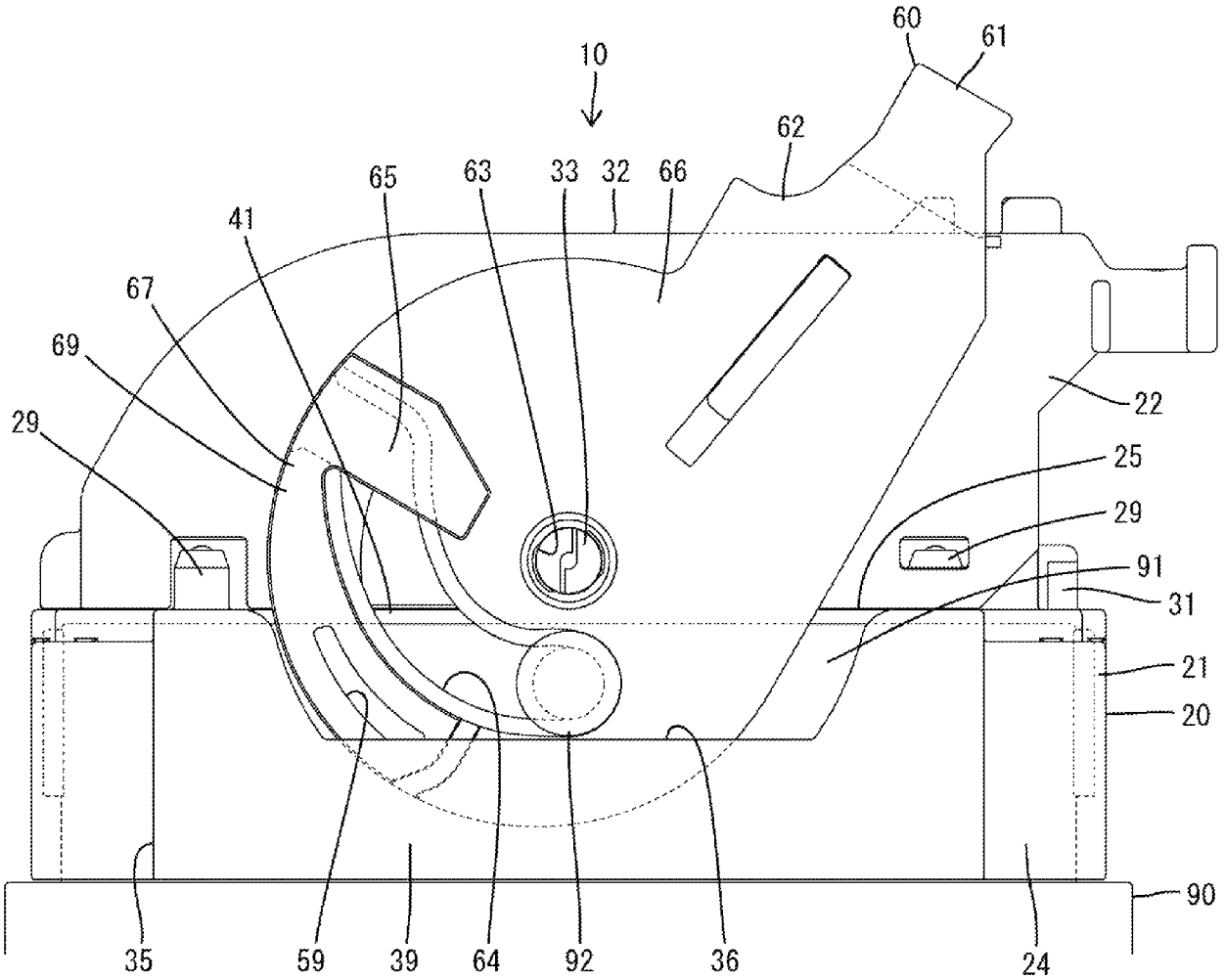
FIG. 3 is a plan view showing a state where the lever is at a connection position.
Figure 7:
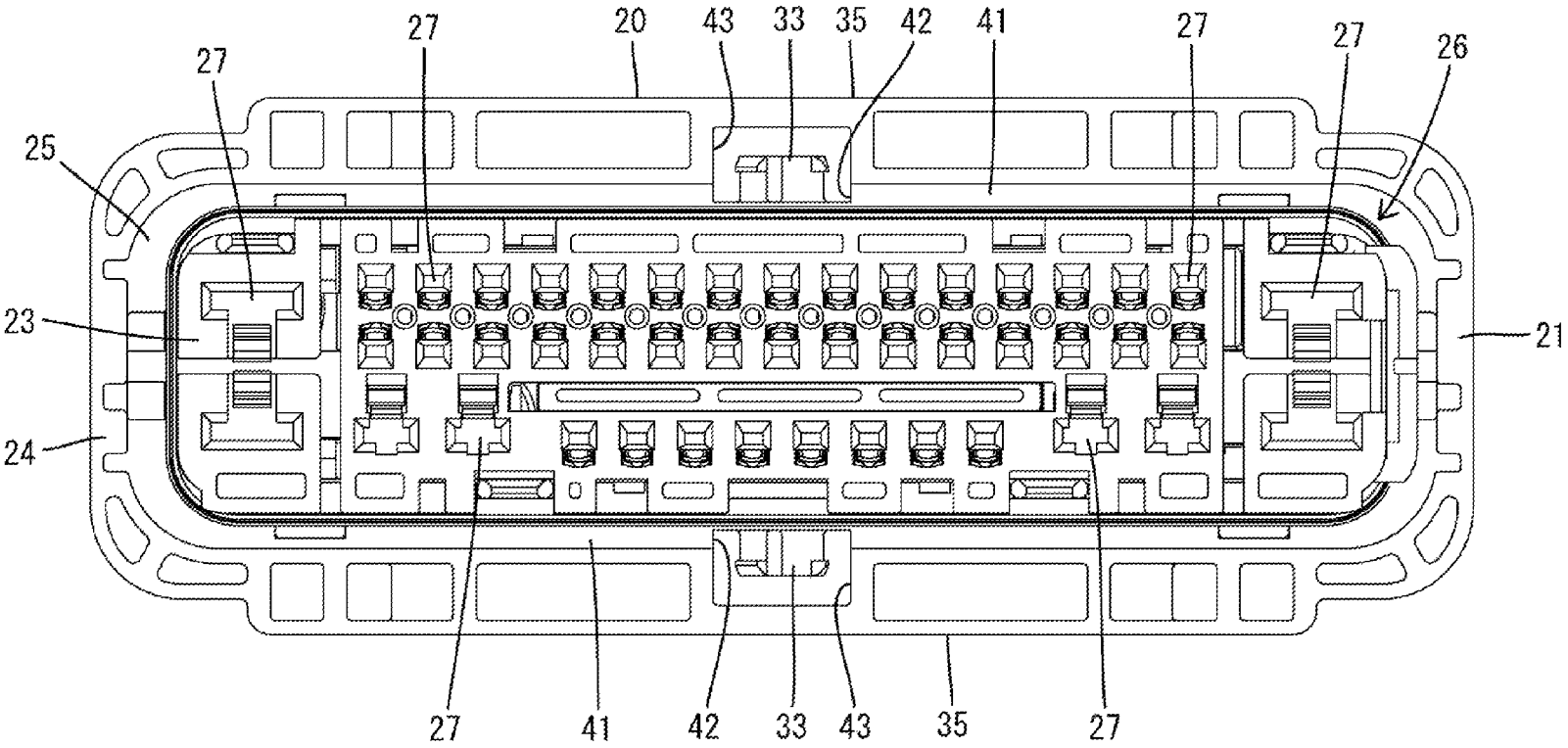
FIG. 7 is a front view of the housing.

As shown in FIG. 3, the housing 20 is made of synthetic resin and includes a housing main body 21 and a wire cover 22. As shown in FIG. 7, the housing main body 21 includes a wide substantially block-shaped terminal accommodating portion 23. A wide substantially rectangular fitting tube 24 substantially in the form of a rectangular tube surrounds the outer periphery of the terminal accommodating portion 23, and a radially extending linking wall 25 (contact-stop wall) links the fitting tube 24 and the terminal accommodating portion 23. A forwardly open connection space 26 is before the linking wall 25 and between the fitting tube 24 and the terminal accommodating portion 23, and the receptacle 91 of the mating housing 90 is insertable therein.

Cavities 27 are provided in the terminal accommodating portion 23, as shown in FIG. 7, and an unillustrated terminal fitting is inserted into each cavity 27 from behind. Each terminal fitting is crimped to an end of an unillustrated wire and is connected electrically conductively to a corresponding male tab when the housings 20, 90 are connected.

Figure 2:
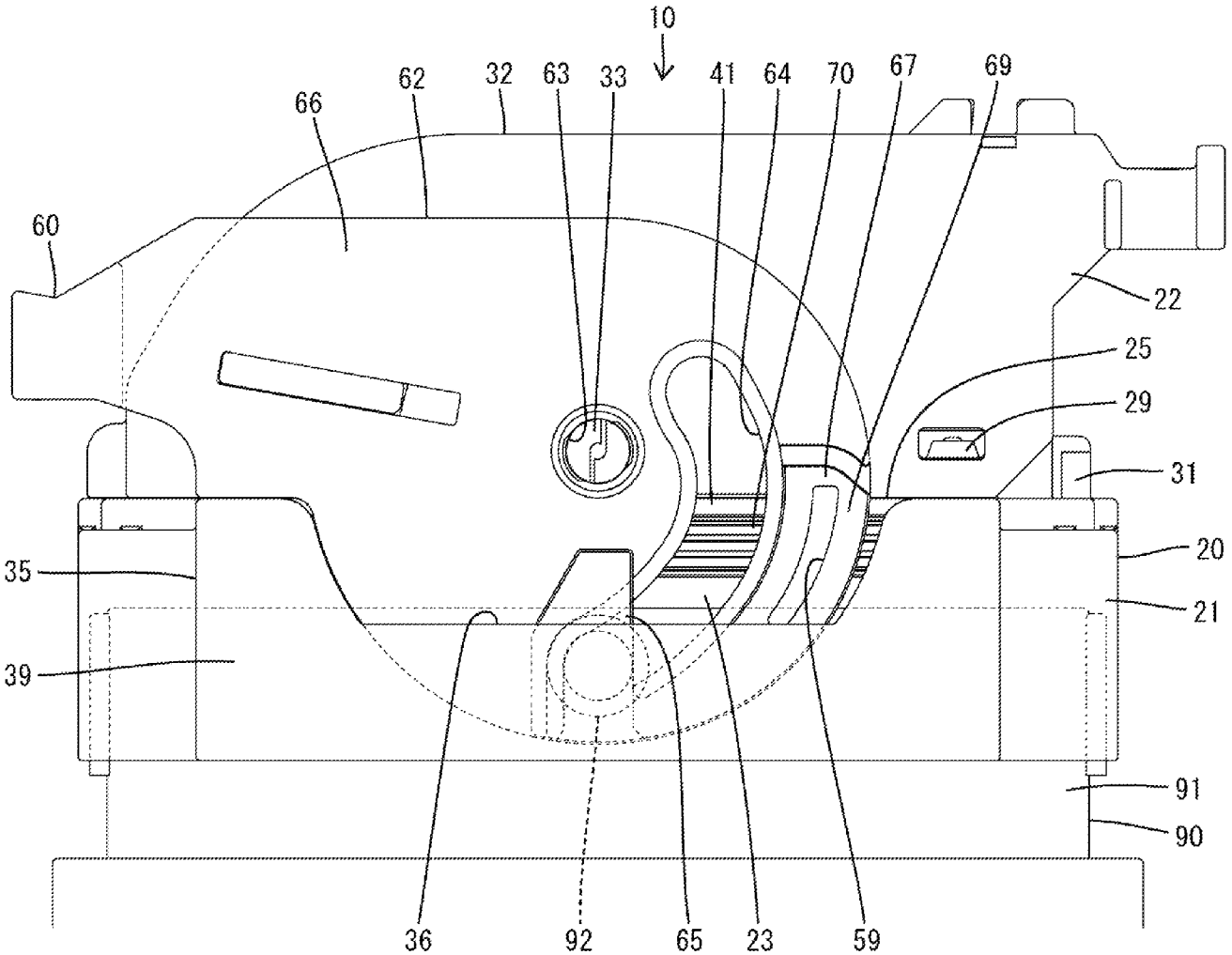
FIG. 2 is a plan view showing a state where the lever is at an initial position.
Figure 6:
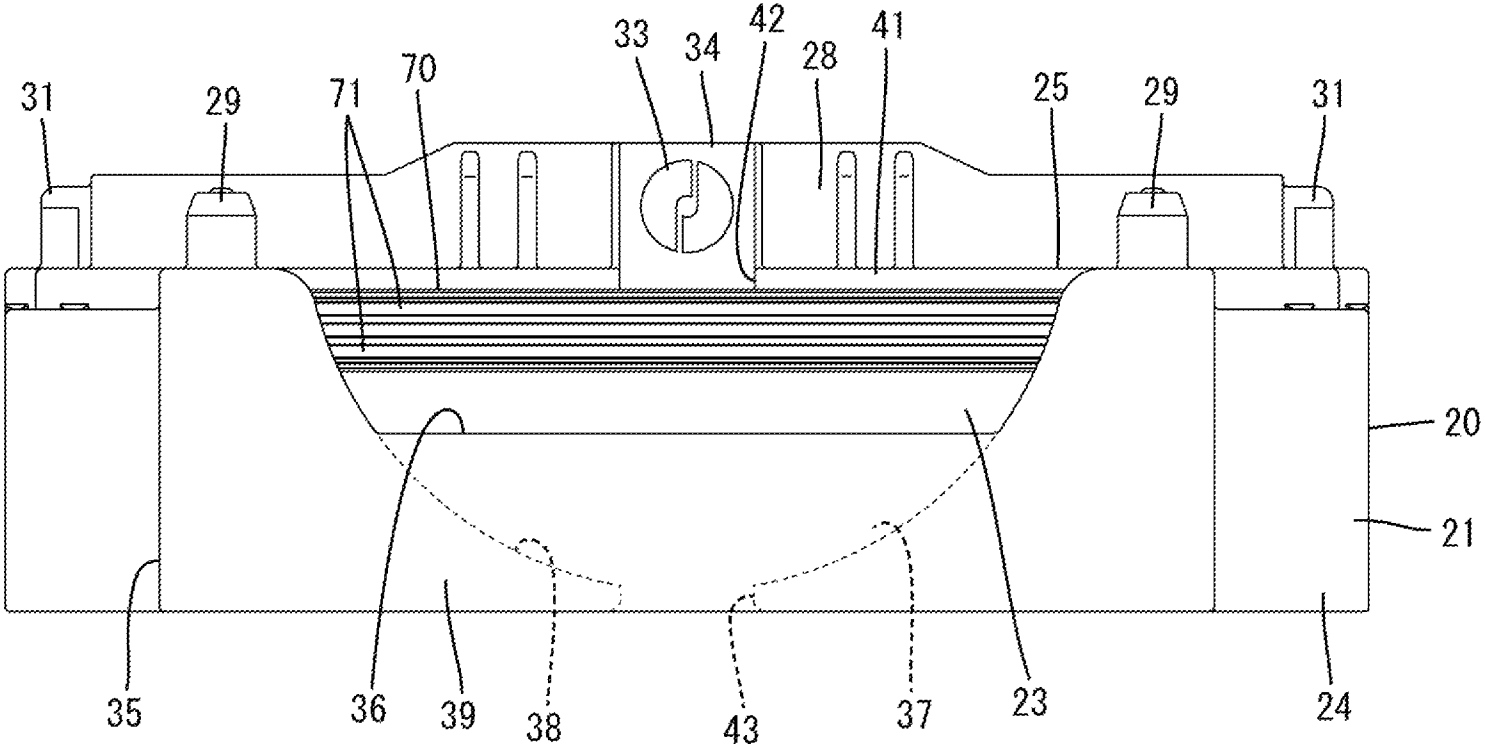
FIG. 6 is a plan view of a housing.

The linking wall 25 radially bulges out from the outer peripheral surface of the housing main body 21 and is arranged so that the wire cover 22 can contact the rear surface of the linking wall 25 from behind, as shown in FIG. 2. A rear end part 28 of the housing main body 21 projects back from the rear surface of the linking wall 25, as shown in FIG. 6, and two lateral cover locks 29 extend back from the rear surface of the linking wall 25 near opposite widthwise ends of each opposite longer side surface of the rear end part 28. Two end cover locks 31 extend back from the rear surface of the linking wall 25 on opposite shorter side surfaces of the housing main body 21.

The wire cover 22 is made of synthetic resin and defines a cap that is open forward and on the right side in FIG. 2. The wire cover 22 covers the rear end part 28 of the housing main body 21 and is in contact with the rear surface of the linking wall 25. An end edge on left side in FIG. 2 is locked by the end cover lock 31 and the side surfaces on the one widthwise side are locked by the lateral cover locks 29 to hold the wire cover 22 on the housing main body 21. The end cover locks 31 and the lateral cover locks 29 are paired on opposite left and right sides so that the wire cover 22 can be locked in either of two opposite orientations. Wires drawn out from the rear surface of the housing main body 21 are accommodated in the wire cover 22 and are bent along a back plate 32 of the wire cover 22 to be pulled out to the outside through the opening on the one widthwise side.

As shown in FIGS. 6 and 7, two shafts 33 are provided in substantially widthwise centers of opposite side surfaces of the rear end part 28 of the housing main body 21. Each shaft 33 is substantially cylindrical and projects on a base 34 having a substantially rectangular plan view, as shown in FIG. 6. Two outward deformation preventing walls 35 are provided on parts of the fitting tube 24 facing the opposite side surfaces of the housing main body 21. Each outward deformation preventing wall 35 bulges outward and includes an escaping portion 36 formed by recessing the rear edge thereof and not linked to the linking wall 25. As shown in FIG. 4, an inner space 37 capable of accommodating an arm plate 62 of the lever 60 is open backward at an inner side of the outward deformation preventing wall 35. The inner space 37 is bordered by a substantially arcuate peripheral surface portion 38, as shown in FIG. 4, and an outer side thereof is closed by a covering wall 39 as shown in FIG. 6. A part corresponding to the escaping portion 36 out of the rear edge of the covering wall 39 extends straight along the width direction.

As shown in FIG. 6, the linking wall 25 has two continuous walls 41 extending along the width direction behind the escaping portions 36 of the respective outward deformation preventing walls 35. Two cut recesses 42 are formed at positions facing the shafts 33 substantially in widthwise centers of the respective continuous walls 41. Further, two introducing recesses 43 are formed at positions facing the shafts 33 substantially in widthwise centers of the respective outward deformation preventing walls 35. The follower pins 92 of the mating housing 90 can enter the respective introducing recesses 43 from the front when the connection of the two housings 20, 90 is started (see FIG. 4).

As shown in FIG. 7, the shafts 33 can be seen from front through the cut recesses 42 and the introducing recesses 43, and front surface parts of the shafts 33 are formed together with the cut recesses 42 and the introducing recesses 43 by pulling out an unillustrated mold forward. Further, the shafts 33 are exposed to the rear side and opposite widthwise sides in addition to the front.

As shown in FIG. 6, a seal ring 70 is mounted on the outer periphery of the terminal accommodating portion 23 of the housing main body 21. The seal ring 70 is made of rubber, such as silicon rubber, and closely contacts the entire outer peripheral surface of the terminal accommodating portion 23. Outer lips 71 are formed circumferentially on the outer peripheral surface of the seal ring 70 and are juxtaposed in a front-back direction. Further, unillustrated inner lips are formed circumferentially on the inner peripheral surface of the seal ring 70 and are juxtaposed in the front-back direction. The seal ring 70 is mounted onto the outer peripheral surface of the terminal accommodating portion 23 from the front and contacts the front surface of the linking wall 25. When the two housings 20, 90 are connected, each inner lip is held resiliently in close contact with the outer peripheral surface of the housing main body 21 and each outer lip 71 is held resiliently in close contact with the inner peripheral surface of the receptacle 91. Thus, the seal ring 70 is compressed resiliently between the two housings 20, 90 to provide sealing between the two housings 20, 90. Note that the seal ring 70 is a different color from the housing 20 and the lever 60 to have good visibility.

Figure 8:
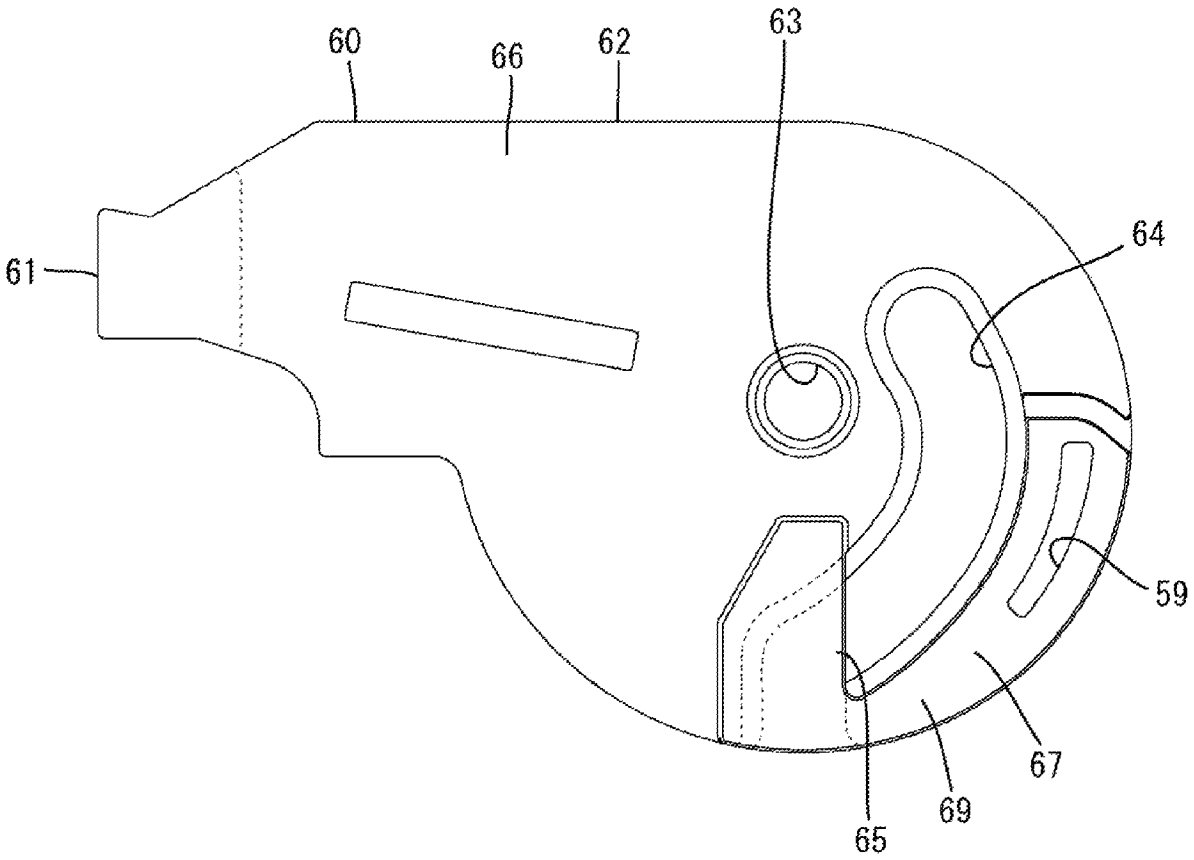
FIG. 8 is a plan view of the lever.
Figure 9:
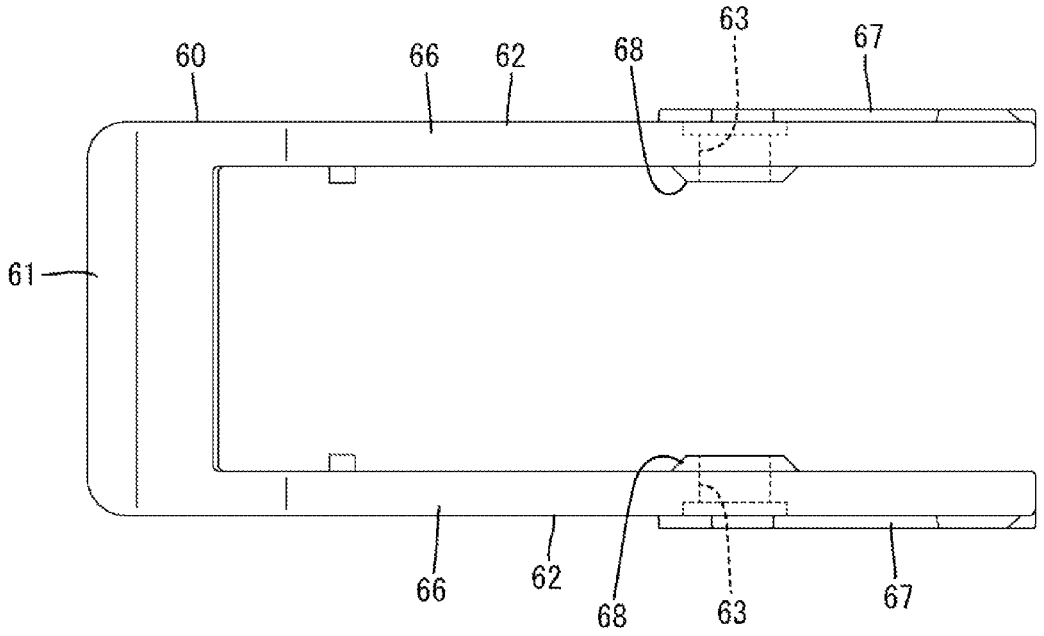
FIG. 9 is a rear view of the lever.

The lever 60 is made of synthetic resin and, as shown in FIG. 9, includes a coupling 61 extending along a height direction and two arm plates 62 projecting in the width direction substantially in parallel with each other from opposite ends of the coupling 61 in the height direction to define a U-shape. A bearing hole 63 penetrates each arm plate 62. As shown in FIG. 8, each arm plate 62 has a curved cam groove 64 that opens on the outer periphery edge of the arm plate 62. Each cam groove 64 penetrates through the arm plate 62 in a plate thickness direction except at an entrance part open on the outer peripheral edge of the arm plate 62. A bridge 65 covers the entrance part of the cam groove 64 on the outer surface of an outer peripheral edge part of the arm plate 62.

Figure 1:
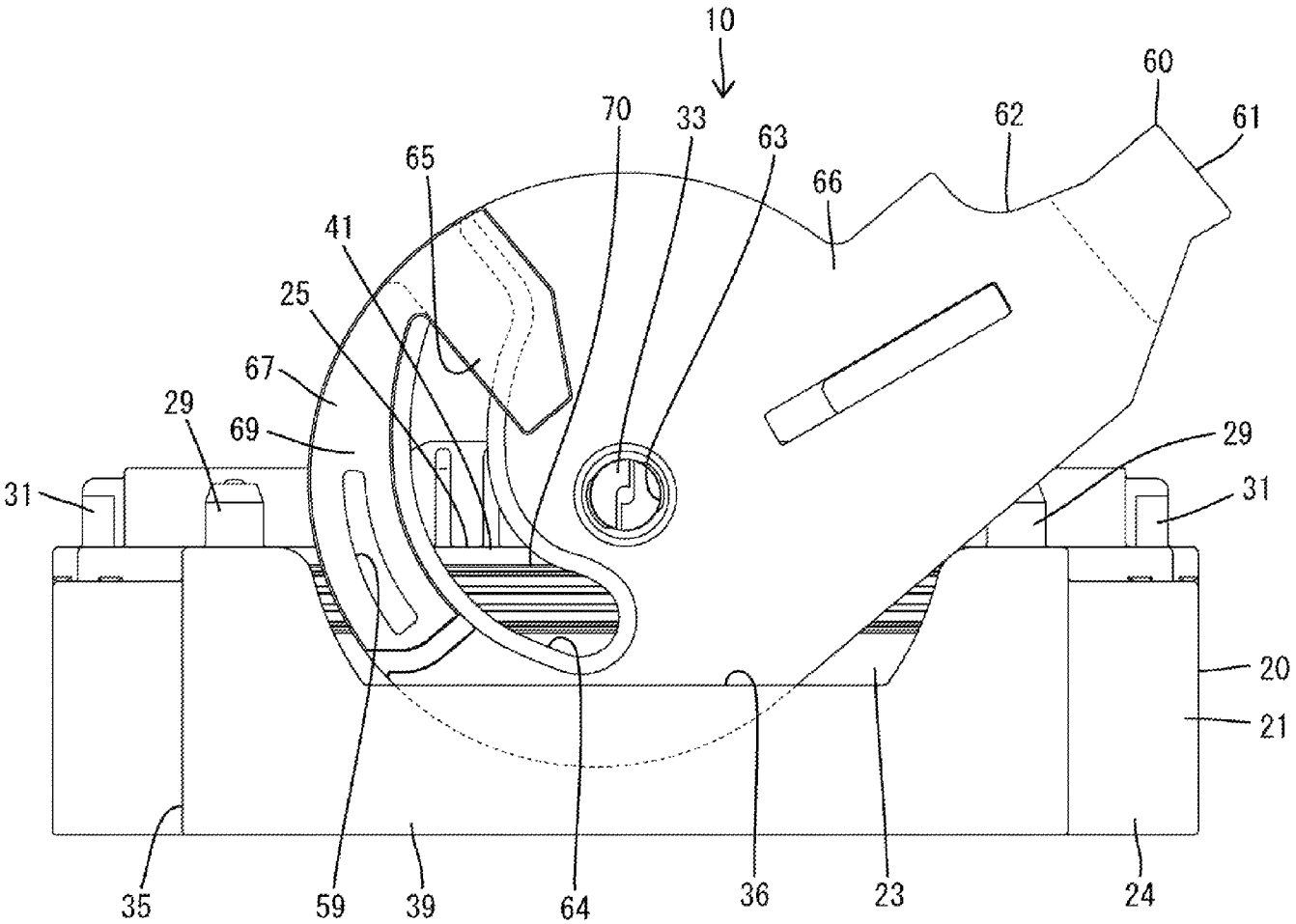
FIG. 1 is a plan view of a lever-type connector of one embodiment of the invention showing a state where a lever is at an assembled position.

As shown in FIG. 1, the lever 60 is mounted from behind to straddle the terminal accommodating portion 23 of the housing main body 21 and the shafts 33 are fit resiliently into the bearing holes 63 so that the lever 60 is supported on the housing main body 21 for rotation about the shafts 33. Specifically, the lever 60 is rotatable, relative to the housing main body 21 between an assembled position (see FIG. 1) where the coupling 61 is inclined significantly to the right, as shown, an initial position (see FIG. 2) where the coupling 61 is inclined significantly to the left, as shown, and a connection position (see FIG. 3) where the coupling portion 61 is inclined slightly to the right, as shown.

Figure 10:
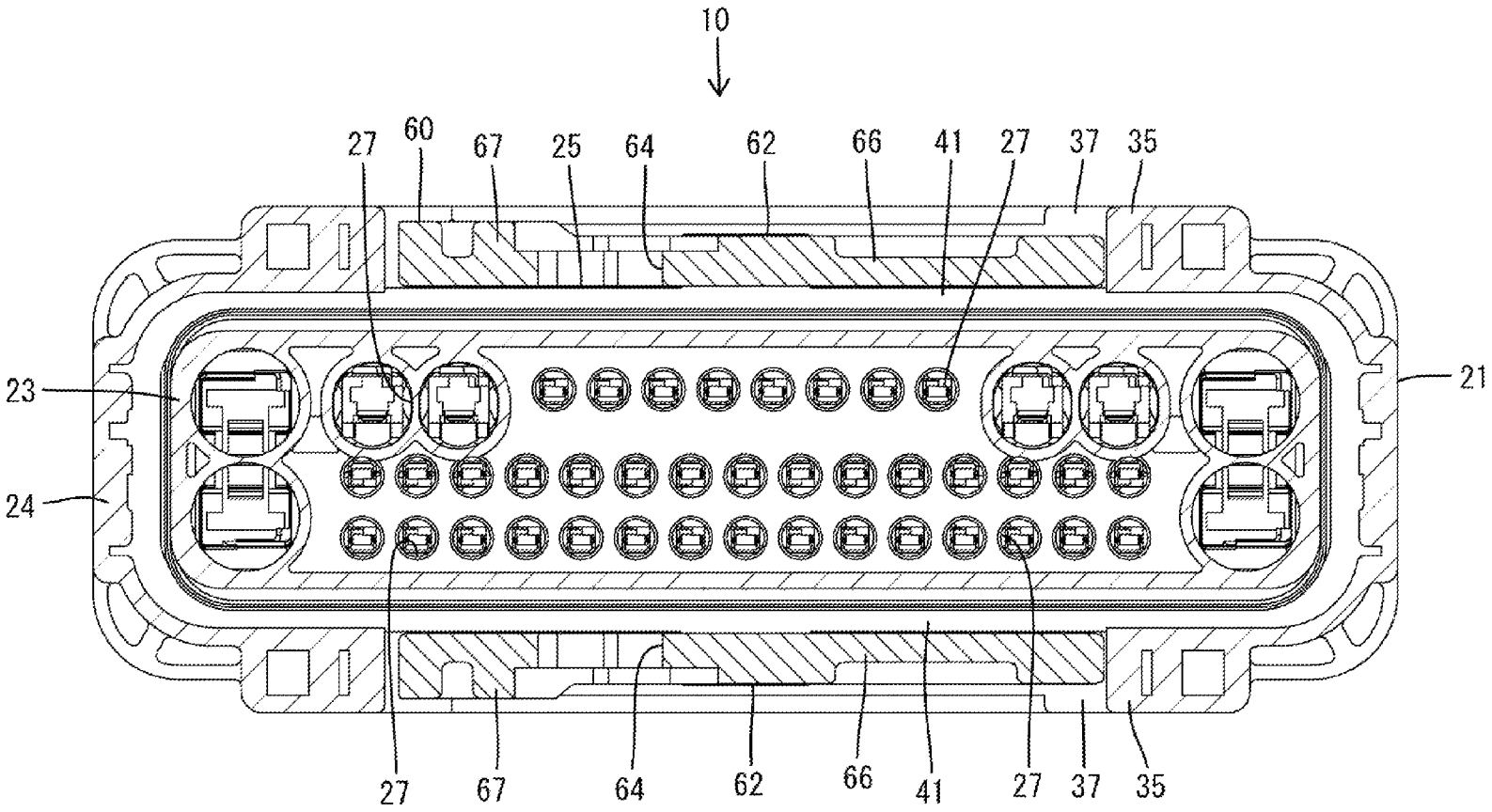
FIG. 10 is a front view in section showing a state where the lever is assembled with a housing main body.

When the lever 60 is assembled with the housing main body 21, the continuous panels 41 of the linking wall 25 are near inner sides of the respective arm plates 62, as shown in FIG. 10. The arm plates 62 could incline slightly inward with positions coupled to the coupling 61 as supports. However, the inwardly inclined arm plates 62 immediately contact the continuous panels 41, thereby preventing further inclination and preventing the arm plates 62 from being deflected and deformed excessively inward.

Each arm plate 62 has a thin portion 66 and a thick portion 67. The thin portion 66 is in an unhatched blank area of the arm plate 62 in FIG. 4 and is in a wide range from the coupling 61 to the outer peripheral edge of the arm plate 62.

The thick portion 67 is in the hatched area of each arm plate 62 in FIG. 4 of each arm plate 62 and has a larger plate thickness than the thin portion 66. A ratio of the thick portion 67 in the entire arm plate 62 is sufficiently smaller than the thin portion 66. As shown in FIG. 9, the thick portion 67 is thickened on an outer surface side of each arm plate 62, and the outer surface of the thick portion 67 is more outward than the outer surface of the thin portion 66. On the other hand, the inner surface of the thick portion 67 is substantially flush and continuous with the inner surface of the thin portion 66 except at a boss 68 formed on an opening edge part of the bearing hole 63. Specifically, as shown in FIG. 8, the thick portion 67 includes the bridge 65 and an extending portion 69 located between the outer peripheral edge of the arm plate 62 and the cam groove 64 and extending along the outer peripheral edge of the arm plate 62 and is arranged from the bridge 65 to a position corresponding to an intermediate position of the cam groove 64 in an extending direction. Note that a recess 59 in the form of a slit groove is formed at an intermediate position of the outer surface of the thick portion 67 in an extending direction, and a part corresponding to this recess 59 is the thin portion 66.

The lever 60 is assembled with the housing main body 21 at the assembled position, as shown in FIG. 1. During assembly, the lever 60 is mounted on the housing main body 21 before mounting the wire cover 22. At this time, the thin portions 66 of the respective arm plates 62 are inserted into the inner spaces 37 of the outward deformation preventing walls 35 and relatively large clearances are formed between the covering walls 39 of the outward deformation preventing walls 35 and the thin portions 66. The arm plates 62 interfere with the shafts 33 during assembly and deform outward with the positions coupled to the coupling 61 as support points. At this time, the thin portions 66 of the arm plates 62 are deformed outward within the ranges of the clearances, thereby avoiding the interference between the thin portions 66 and the covering walls 39. Further, even if the thin portions 66 interfere with the covering walls 39, sliding resistance does not become particularly large since the amount of interference is small. In this way, the lever 60 is assembled at the assembled position with good efficiency.

The absence of the wire cover 22 on the housing main body 21 at the assembled position enables the coupling 61 of the lever 60 to be inclined a large amount to the right side as shown in FIG. 1. Further, at the assembled position, the thick portions 67 are located behind and at a distance from the straight rear edges of the escaping portions 36 of the outward deformation preventing walls 35. Furthermore, at the assembled position, the recessed inner sides of the escaping portions 36 and the cam grooves 64 of the lever 60 are arranged to communicate in the height direction. The seal ring 70 is mounted on the outer peripheral surface of the housing main body 21 and contact with the continuous panels 41 of the linking wall 25 can be confirmed visually from the outside through the recessed inner sides of the escaping portions 36 and the cam grooves 64. Thus, the cam grooves 64 function as confirmation windows. Note that, the seal ring 70 can be seen over the entire width in the front-back direction.

The lever 60 then is rotated to the initial position and the wire cover 22 is mounted on the housing main body 21. The coupling 61 is on the left side when the lever 60 reaches the initial position, as shown, and the entrances of the cam grooves 64 face forward and communicate with the introducing recesses 43 of the outward deformation preventing walls 35 (see FIG. 4). Further, at the initial position, the thick portions 67 of the respective arm plates 62 are in the inner spaces 37 of the outward deformation preventing walls 35 to form smaller clearances between the covering walls 39 and the thick portions 67 than at the assembled position. Furthermore, at the initial position, the seal ring 70 and the continuous panels 41 can be seen through the recessed inner sides of the escaping portions 36 and the cam grooves 64 (see FIG. 2).

The mating housing 90 then is connected lightly to the housing main body 21 so that the receptacle 91 of the mating housing 90 enters the connection space 26 of the housing 20 and the follower pins 92 are inserted into the entrances of the cam grooves 64 through the introducing recesses 43, as shown in FIG. 4. At this time, the receptacle 91 is spaced from the seal ring 70 and the seal ring 70 still can be seen.

The lever 60 then is rotated to the connection position by gripping the coupling 61. As a result, the follower pins 92 slide on groove surfaces of the cam grooves 64 and a force multiplying action works between the lever 60 and the mating housing 90 to pull the mating housing 90 toward the housing 20 with a small connecting force. The seal ring 70 is covered gradually by the receptacle 91 and a visible area of the seal ring 70 gradually decreases as the connecting operation proceeds. Further, the thick portions 67 of the arm plates 62 remain within the inner spaces 37 of the outward deformation preventing walls 35 during the connecting process. The arm plates 62 may be urged outward in response to the connecting force. However, the thick portions 67 immediately contact the covering walls 39 of the outward deformation preventing walls 35 to prevent excessive outward deformation of the arm plates 62.

Figure 5:
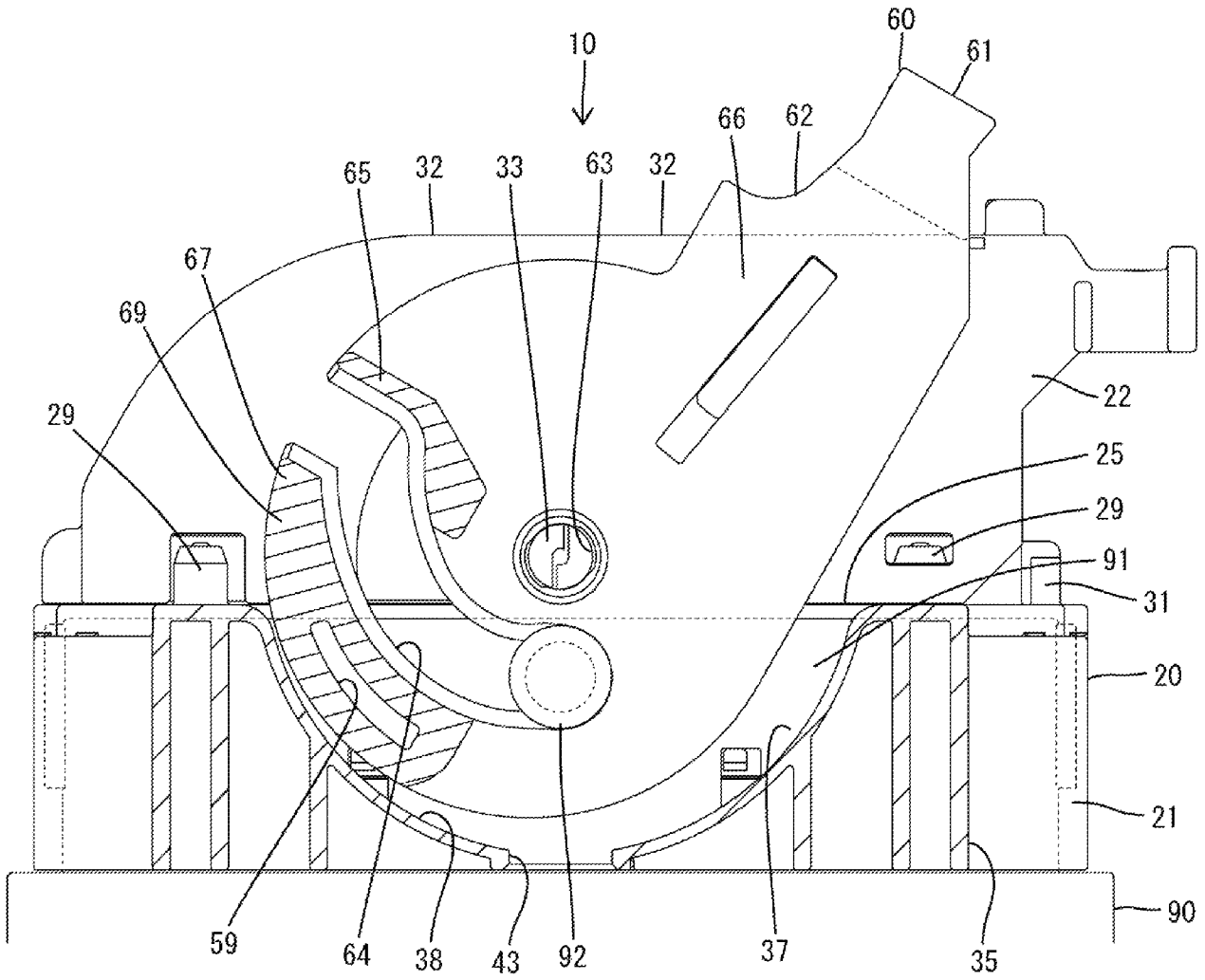
FIG. 5 is a plan view, partly in section, showing the lever at the connection position.

The coupling 61 contacts the back plate 32 of the wire cover 22, as shown in FIGS. 3 and 5, to prevent any further rotation and the follower pins 92 reach back ends of the cam grooves 64 when the lever 60 reaches the connection position. The housings 20, 90 are connected properly and each terminal fitting is connected electrically conductively to the corresponding male tab. The thick portions 67 of the arm plates 62 remain in the inner spaces 37 of the outward deformation preventing walls 35, as shown in FIG. 5, even when the lever 60 reaches the connection position. At the connection position, the receptacle 91 is stopped in contact with the linking wall 25 and the seal ring 70 is entirely covered by the receptacle 91, as shown in FIG. 3. Thus, although the receptacle 91 and the continuous panels 41 can be seen through the recessed inner sides of the escaping portions 36 and the cam grooves 64, the seal ring 70 cannot be seen. Further, at the connection position, the seal ring 70 is sandwiched resiliently between the receptacle 91 and the housing main body 21 to ensure sealing between the two housings 20, 90. Thus, if the seal ring 70 is concealed by the receptacle 91, it can be judged that the two housings 20, 90 have reached a proper connection position and sealing between the two housings 20, 90 is ensured.

The housing 20 has no wall for covering the outer side of the seal ring 70 to ensure the visibility of the seal ring 70. Thus, no wall is in front of the shafts 33, and the front surfaces of the shafts 33 can be formed easily together with the cut recesses 42 and the introducing recesses 43 by the mold to be pulled out forward. Further, by simplifying a mold structure, a degree of freedom in forming the shafts 33 can be increased and the shafts 33 can be configured to reduce chances of fracturing.

The thin portions 66 of the arm plates 62 enter the inner spaces 37 of the outward deformation preventing walls 35 at the assembled position. Thus, sufficient escaping spaces exist for the arm plates 62 to deform out due to the interference with the shafts 33. Thus, sliding resistance due to the interference of the arm plates 62 and the outward deformation preventing walls 35 does not become excessive and assembling operability is improved. On the other hand, the thick portions 67 of the arm plates 62 enter the inner spaces 37 of the outward deformation preventing walls 35 in the process of moving the arm plates 62 from the initial position toward the connection position. Thus, the thick portions 67 prevent the arm plates 62 from lifting off the shafts 33 by reliably contacting the outward deformation preventing walls 35 when the arm plates 62 receive the connecting force for the two housings 20, 90. Therefore, operation reliability of the lever 60 is enhanced.

The inner spaces 37 of the outward deformation preventing walls 35 are sufficient to allow the thin portions 66 to deform out at the assembled position. Thus, the outward deformation preventing walls 35 need not bulge outward a large amount and the entire connector can be small.

The assembled position and the initial position of the lever 60 are different from each other. Thus, the thick portions 67 of the arm plates 62 will not enter the inner spaces 37 of the outward deformation preventing walls 35 at the assembled position.

The thin portion 66 occupies more of the arm plate 62 than the thick portion 67. Thus, the lever 60 weighs less and costs less. Furthermore, the thick portions 67 extend along the outer peripheries of the arm plates 62 to ensure rigidity of the outer peripheral edges of the arm plates 62.

The invention is not limited to the above described embodiment. For example, the following modes also are included in the scope of the invention.

Part of the seal ring may be seen when the lever reaches the connection position. Thus, the connected state of the housings and the sealing state of the seal ring can be confirmed by managing a visible amount of the seal ring at the connection position.

If the cam grooves are bottomed grooves, the lever may have a dedicated confirmation window for confirming the state of the seal ring.

The assembled and initial positions of the lever may be the same position.

The shafts and the outward deformation preventing walls may be on the wire cover.

The thick portions may be formed by thickening inner surfaces of the arm plates or both inner and outer surface sides of the arm plates.

The lever may be a rack and pinion type or leverage type lever with no cam groove.

What is claimed is:

1. A lever-type connector, comprising:

a housing connectable to a mating housing and including a front end that is connectable to the mating housing and a rear end opposite the front end, the housing further having a terminal accommodating portion extending substantially from the front end to the rear end and a substantially tubular fitting wall outward of the terminal accommodating portion, shafts projecting on opposite side surfaces and a contact-stop wall projecting from the opposite side surfaces between the terminal accommodating portion and the fitting wall and a forwardly open connection space being defined between the terminal accommodating portion and the fitting wall at positions forward of the contact stop wall, the contact stop wall being capable of stopping the mating housing;

a seal ring mounted on the housing adjacent the contact-stop wall and being sandwiched in a fluid-tight manner between the two housings when the two housings are connected; and a lever including a coupling and arm plates projecting from opposite ends of the coupling to define a U-shape, the lever being mounted from an outer side to straddle the housing and being rotatable about the shafts while being engaged with the mating housing to generate a force multiplying action for connecting the two housings;

wherein the contact-stop wall is arranged at a position facing the arm plates from inner sides of the arm plates and a confirmation window is provided in at least one of the arm plates through which the seal ring is visible, and wherein the fitting wall of the housing includes outward deformation preventing walls at outer sides of the arm plates to prevent excessive outward deformation of the arm plates when rotating the lever, at least one of the outer deformation preventing walls including an escaping portion defining an opening in at least one of the deformation preventing walls and extending from the contact-stop wall to a location forward of the seal ring and communicating with the confirmation window to make the seal ring visible.

2. The lever-type connector of claim 1, wherein the confirmation window is a cam groove that exhibits the force multiplying function by being engaged with a follower pin of the mating housing.

3. The lever-type connector of claim 1, wherein the shafts are exposed on a front end of the housing that is connectable to the mating housing.

4. A lever-type connector, comprising:

a housing having a front end that is connectable to a mating housing and a rear end opposite the front end, the housing further having:

a terminal accommodating portion extending from the front end to the rear end;

a contact stop wall extending out from the terminal accommodating wall at a position rearward of the front end of the housing;

at least one shaft projecting out from the housing rearward of the contact stop wall;

a tubular fitting wall projecting forward from the contact stop wall and defining a forwardly open connection space between the terminal accommodating portion and the fitting wall, the tubular fitting wall including at least one outward deformation preventing wall on at least one side of the housing that has the at least one shaft; and at least one escaping opening formed in the at least one deformation preventing wall and extending forward from the contact-stop wall;

a seal ring mounted over the terminal accommodating portion forward of and adjacent to the contact stop wall; and a lever having at least one arm plate mounted rotatably to the at least one shaft and disposed at least partly between the terminal accommodating portion and the at least one deformation preventing wall, a confirmation window being provided in the at least one arm plate so that a portion of the seal ring aligned with the escaping opening is visible through both the escaping opening and the confirmation window.

5. The lever-type connector of claim 4, wherein the confirmation window is a cam groove that exhibits the force multiplying function by being engaged with a follower pin of the mating housing.

6. The lever-type connector of claim 5, wherein the lever includes a coupling and the at least one arm plate comprises two arm plates projecting respectively from opposite ends of the coupling to define a U-shape, the lever being mounted from an outer side to straddle the housing.

* * * * *